US012426647B2

(12) United States Patent
Deilmann

(10) Patent No.: US 12,426,647 B2
(45) Date of Patent: Sep. 30, 2025

(54) GARMENT HAVING REPLACEABLE PORTIONS

(71) Applicant: W.L. Gore & Associates GmbH, Putzbrunn (DE)

(72) Inventor: Clemens Deilmann, Rimsting (DE)

(73) Assignee: W.L. Gore & Associates GmbH, Putzbrunn (DE)

( * ) Notice: Subject to any disclaimer, the term of this patent is extended or adjusted under 35 U.S.C. 154(b) by 0 days.

(21) Appl. No.: 18/692,535

(22) PCT Filed: Sep. 16, 2022

(86) PCT No.: PCT/IB2022/000521

§ 371 (c)(1),
(2) Date: Mar. 15, 2024

(87) PCT Pub. No.: WO2023/041981

PCT Pub. Date: Mar. 23, 2023

(65) Prior Publication Data

US 2024/0407477 A1 Dec. 12, 2024

Related U.S. Application Data

(60) Provisional application No. 63/245,463, filed on Sep. 17, 2021.

(51) Int. Cl.
*A41D 27/24* (2006.01)
*A41D 1/06* (2006.01)

(52) U.S. Cl.
CPC ..... *A41D 1/06* (2013.01); *A41D 27/24* (2013.01)

(58) Field of Classification Search
CPC ..... A41D 27/24; A41D 15/002; A41D 13/11; A41D 13/112; A41D 17/00; A41D 17/005;

(Continued)

(56) References Cited

U.S. PATENT DOCUMENTS 1,820,631 A * 8/1931 Penn ..... A41H 43/00 2/239
2,136,879 A * 11/1938 Haber ..... A41D 27/10 2/270

(Continued)

FOREIGN PATENT DOCUMENTS

CN 210642579 U 6/2020
CN 211983979 U 11/2020

(Continued)

OTHER PUBLICATIONS

International Search Report and Written Opinion from International Application No. PCT/IB2022/000521 dated Jan. 30, 2023.

*Primary Examiner* — Jillian K Pierorazio
(74) *Attorney, Agent, or Firm* — GREENBERG TRAURIG, LLP

(57) ABSTRACT

A garment (10) includes a first garment portion (22); a second garment portion (24); a third garment portion (26); a waterproof fastener system configured to join the first garment portion (22) and the second garment portion (24); and a non-waterproof fastener system (32) configured to join the first garment portion (22) and the third garment portion (26). The waterproof fastener system can be disconnected and rejoined without removing the third garment portion. The waterproof fastener system can include a first connection joining the first garment portion to the second garment portion. The non-waterproof fastener system can include a second connection (32) joining the first garment portion to the third garment portion. The second connection can be configured to withstand repeated repair and be disconnected and rejoined.

20 Claims, 8 Drawing Sheets

(58) Field of Classification Search
CPC ..... A41D 17/02; A41D 19/0037; A41D 3/00; A41D 3/04
See application file for complete search history.

(56) References Cited

U.S. PATENT DOCUMENTS 4,200,938 A * 5/1980 LeTourneau ..... A41D 1/06 2/269
4,753,182 A * 6/1988 Blackburn ..... A41D 27/24 112/419
5,361,415 A * 11/1994 Deering ..... A41D 19/01 2/160
5,575,010 A * 11/1996 Chung ..... A41D 1/06 2/269
5,608,915 A * 3/1997 Libit ..... A41D 1/06 2/79
5,628,064 A * 5/1997 Chung ..... A41D 15/00 2/119
5,749,098 A * 5/1998 Evans ..... A41D 19/0041 2/124
5,784,720 A * 7/1998 Mellon ..... A41D 19/0041 2/60
5,885,679 A * 3/1999 Yasue ..... B29C 66/7292 428/57
6,055,673 A * 5/2000 McCormick ..... A41D 1/06 2/232
6,497,934 B1 * 12/2002 Mahn, Jr. ..... B29C 66/112 428/57
7,013,489 B1 * 3/2006 McGrath ..... B63C 9/105 2/69
7,739,751 B2 * 6/2010 Lin ..... A41D 3/06 2/232
8,256,026 B2 * 9/2012 Garrigos ..... A41D 13/0007 70/57.1
8,850,620 B1 * 10/2014 Carretero ..... A41D 15/002 2/269
11,064,747 B2 * 7/2021 Zahradka ..... A41D 27/10
2003/0138586 A1 * 7/2003 Fowler ..... B29C 65/5085 428/102
2004/0123366 A1 * 7/2004 Schorr ..... A41D 27/10 2/69
2004/0143882 A1 * 7/2004 Gardner ..... A41D 13/01 2/81
2005/0022920 A1 * 2/2005 Fowler ..... B29C 65/5042 156/304.3
2006/0165939 A1 * 7/2006 Hottner ..... B29C 66/43 156/304.3
2007/0118957 A1 * 5/2007 Steitle ..... A41D 27/08 2/69
2008/0047654 A1 * 2/2008 Sadato ..... A41D 3/04 156/91
2009/0007309 A1 * 1/2009 Yamashita ..... D04B 1/16 2/243.1
2009/0205112 A1 * 8/2009 Solowey ..... A41D 15/002 2/269
2009/0235427 A1 * 9/2009 Suzuoki ..... A41D 15/002 2/243.1
2010/0306900 A1 * 12/2010 Sadato ..... A41D 3/04 2/87
2012/0167635 A1 * 7/2012 Yamashita ..... A41D 15/002 66/171
2012/0185998 A1 * 7/2012 Hagen ..... A41D 17/005 2/227
2012/0227153 A1 * 9/2012 Laycock ..... A41D 27/10 2/88
2013/0212768 A1 * 8/2013 Robinson ..... A61H 36/00 2/69
2013/0318677 A1 12/2013 Liu
2016/0255890 A1 * 9/2016 Wangbunyen ..... A41D 27/24
2018/0168257 A1 * 6/2018 Liu ..... A41D 27/14
2018/0255853 A1 * 9/2018 Spathas ..... A41D 1/21
2018/0339487 A1 * 11/2018 Gallagher ..... B29C 65/5042
2019/0021417 A1 * 1/2019 Kroecher ..... A41D 15/002
2019/0239583 A1 * 8/2019 Bakkamanthala ..... A41D 27/24
2020/0146374 A1 * 5/2020 Thompson ..... A41D 27/10
2020/0170316 A1 * 6/2020 Barski ..... A41D 1/06
2020/0205495 A1 * 7/2020 Miktuk ..... A41D 27/06
2020/0345090 A1 * 11/2020 Zahradka ..... A41D 19/0048
2021/0000191 A1 * 1/2021 Antufjew ..... A41D 31/04
2021/0052022 A1 * 2/2021 George ..... A41D 27/24
2022/0071315 A1 * 3/2022 Wen ..... B29C 65/02
2022/0095721 A1 * 3/2022 Alford ..... A41D 17/00
2023/0276875 A1 * 9/2023 O'Leary ..... A41D 15/002 2/269

FOREIGN PATENT DOCUMENTS

CN 119111883 A * 12/2024
GB 678747 9/1952
JP 200206616 A 9/2002
KR 100298646 B 10/2001
KR 101448407 B 10/2014

* cited by examiner

GARMENT HAVING REPLACEABLE PORTIONS

RELATED APPLICATIONS

This application is a national phase filing under 35 USC 371 of International Application No. PCT/IB2022/000521, filed on Sep. 16, 2022, and entitled "GARMENT HAVING REPLACEABLE PORTIONS," which claims priority to U.S. Provisional Application No. 63/245,643, filed on Sep. 17, 2021, and entitled "GARMENT HAVING REPLACEABLE PORTIONS," the entirety of which are hereby incorporated by reference.

FIELD

This disclosure relates generally to a garment. More particularly, this disclosure relates to a garment having one or more replaceable portions.

BACKGROUND

Garments such as, but not limited to, garments for rainy or cold weather activities can include portions which are subject to more wear and tear than other portions of the garment. For example, a pant cuff can show more wear and tear than the upper leg of the same pants. As a result, the pant cuff may be ready for replacement before the upper leg of the same pants.

SUMMARY

In some embodiments, a garment includes a first garment portion; a second garment portion; a third garment portion; a waterproof fastener system configured to join the first garment portion and the second garment portion; and a non-waterproof fastener system configured to join the first garment portion and the third garment portion. In some embodiments, the waterproof fastener system is disconnected and rejoined without removing the third garment portion. In some embodiments, the waterproof fastener system includes a first connection joining the first garment portion to the second garment portion. In some embodiments, the waterproof fastener system is configured to prevent water entry through the first connection. In some embodiments, the non-waterproof fastener system includes a second connection joining the first garment portion to the third garment portion. In some embodiments, the second connection is configured to withstand repeated repair; and be disconnected and rejoined.

In some embodiments, the first garment portion is a pants leg, the second garment portion is a pants cuff, and the third garment portion is a gaiter.

In some embodiments, the second connection is visibly different from other connections of the garment.

In some embodiments, the second connection is a different color from other connections of the garment.

In some embodiments, the second connection is a stitched connection. In some embodiments, the stitched connection is a different stitch pattern from other stitches of the garment.

In some embodiments, the second garment portion and the third garment portion is not a patch.

In some embodiments, the first garment portion is a jacket, the second garment portion is a sleeve, and the third garment portion is a snow skirt, a sleeve gaiter, or a jacket hood.

In some embodiments, the waterproof fastener system includes a first stitched connection and a sealed seam.

In some embodiments, the waterproof fastener system consists essentially of a first stitched connection and a sealed seam.

In some embodiments, the waterproof fastener system consists of a first stitched connection and a sealed seam.

In some embodiments, a method includes receiving a garment including a plurality of garment portions. In some embodiments, the plurality of garment portions includes a first garment portion, a second garment portion, and a third garment portion. In some embodiments, the first garment portion and the second garment portion are joined by a waterproof fastener system. In some embodiments, the waterproof fastener system includes a first stitched connection and a sealed seam. In some embodiments, the first garment portion and the third garment portion are joined by a second connection that is configured to withstand repeated repair and be disconnected and rejoined. In some embodiments, the second garment portion, the third garment portion, or both the second garment portion and the third garment portion are damaged. In some embodiments, the method includes removing the damaged second garment portion from the first garment portion. In some embodiments, the method includes providing a fourth garment portion corresponding to an undamaged replacement portion for the second garment portion, the third garment portion, or any combination thereof. In some embodiments, the method includes providing a repair connection between the fourth garment portion and the first garment portion. In some embodiments, the stitched repair connection is configured to withstand repeated repair and be disconnected and rejoined. In some embodiments, the method includes providing the garment.

In some embodiments, the repair connection is visibly different from other connections of the garment.

In some embodiments, the repair connection is a stitched connection.

In some embodiments, the repair connection is visibly different from other connections of the garment.

In some embodiments, removing the damaged second garment portion from the first garment portion at a region proximate to the waterproof fastener system or removing the damaged third garment portion from the first garment portion at the second connection, includes cutting the first garment portion at a location proximate to the waterproof fastener system.

In some embodiments, removing the damaged second garment portion from the first garment portion at a region proximate to the waterproof fastener system or removing the damaged third garment portion from the first garment portion at the second connection, includes removing a stitch forming the second connection.

In some embodiments, the fourth garment portion corresponds to the undamaged third garment portion and the method includes providing a fifth garment portion corresponding to an undamaged replacement portion for the third garment portion.

In some embodiments, the method includes providing a repair connection between the fifth garment portion and the first garment portion. In some embodiments, the fifth garment portion is joined to provide a repair connection. In some embodiments, the repair connection is configured to withstand repeated repair and be disconnected and rejoined.

In some embodiments, the repair connection is a stitched connection.

In some embodiments, the repair connection is visibly different from other connections of the garment.

In some embodiments, the fourth garment portion is joined and seam sealed to provide a waterproof repair fastener system when the fourth garment portion corresponds to the undamaged second garment portion.

In some embodiments, the fourth garment portion is joined to provide a repair connection when the fourth garment portion corresponds to the undamaged third garment portion.

BRIEF DESCRIPTION OF THE DRAWINGS

References are made to the accompanying drawings that form a part of this disclosure and that illustrate embodiments in which the systems and methods described in this Specification can be practiced.

Like reference numbers represent the same or similar parts throughout.

DETAILED DESCRIPTION

Garments such as, but not limited to, garments for rainy or cold weather activities can include portions which are subject to more wear and tear than other portions of the garment. For example, a pant cuff can show more wear and tear than the upper leg of the same pants. As a result, the pant cuff may be ready for replacement before the upper leg of the same pants. This can be especially true in a situation in which the garments are being used by a number of different users, such as for rentals or other multi-user garment applications. It is desirable to have simple, easy replacements so that the heavy wear portions of the garments can be replaced, and the garments continue to appear new.

Some embodiments relate to garments including portions of heavy wear that are easily and quickly replaceable without special tools. As used herein, "easily disconnected" or "easily disconnected and rejoined" means that a person of ordinary skill in the art, such as, but not limited to, a tailor, would have the tools, skills, and knowledge to disconnect or disconnect and rejoin the garment portions. In some embodiments, the garments can include, for example, pants, with the replaceable portion(s) of the pants including a cuff portion and/or a gaiter; jackets, with the replaceable portion(s) of the jacket including a cuff portion and/or a sleeve gaiter; and jackets, with the replaceable portion of the jacket including a snow skirt or a waist portion; jackets, with the replaceable portion of the jacket including a jacket hood. Some embodiments can include combinations of the preceding. Additionally, while the garments with repairable portions will be described in terms of repairing cuffs and gaiters, it is within the scope of the invention that other portions of the garments may also be replaceable using the techniques described herein. Non-limiting examples include a jacket collar which is replaceable, as well as replaceable zipper portions and draw cords and draw cord tunnels.

Figure 1:
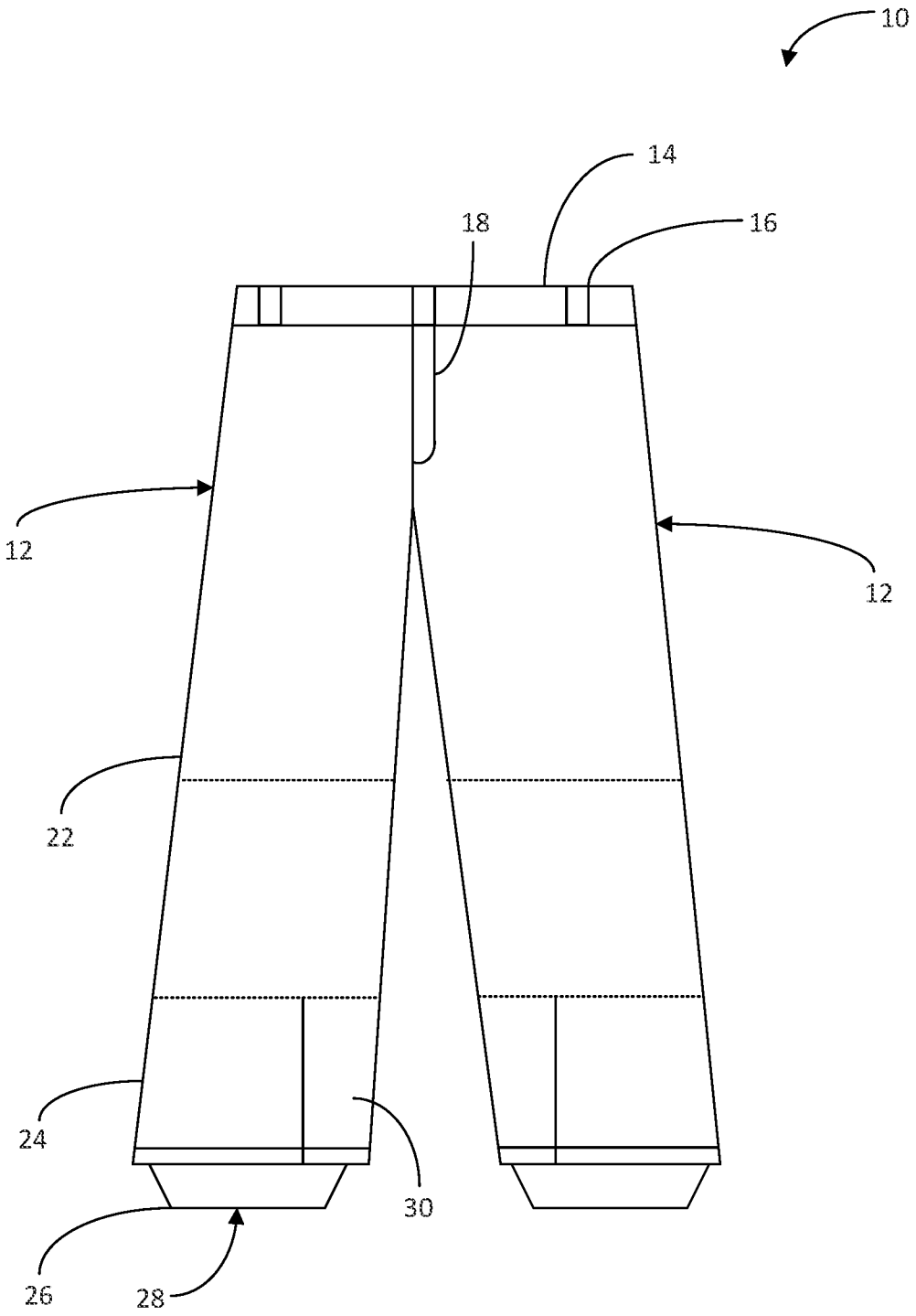
FIGS. 1 and 2 show a frontside (FIG. 1) and a backside (FIG. 2) of a garment, according to some embodiments.
Figure 2:
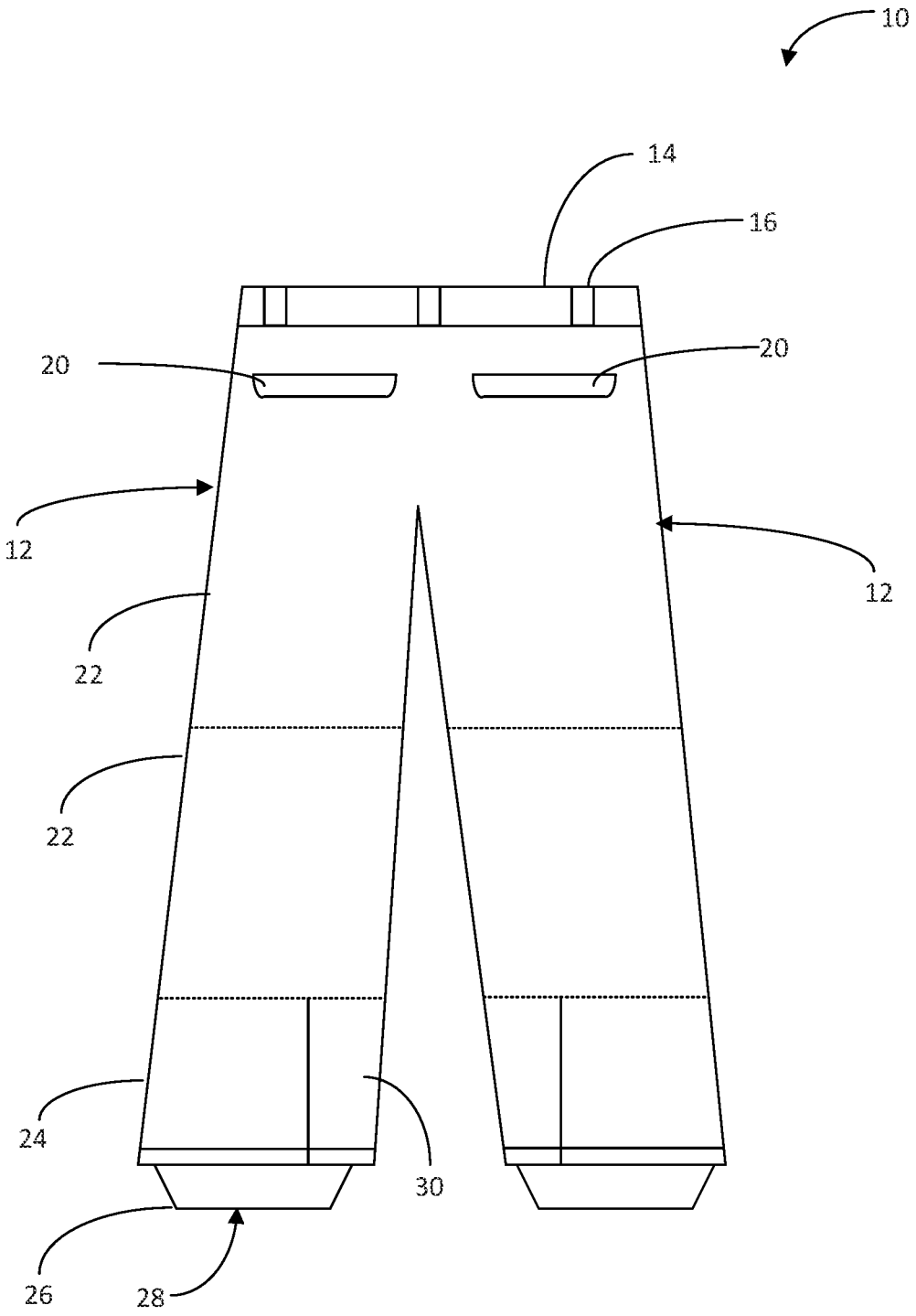

FIGS. 1 and 2 show a frontside (FIG. 1) and a backside (FIG. 2) of a garment 10, according to some embodiments. FIGS. 1-2 will be referenced collectively unless specific reference is made otherwise.

In some embodiments, the garment 10 can be referred to as a clothing article, article, or the like. In the illustrated embodiment, the garment 10 is a pair of pants. In some embodiments, the garment 10 can be a pair of snow pants intended to be worn during, for example, winter activities such as, but not limited to, snow skiing, snowboarding, sledding, or the like. Such activities take place in the snow. As a result, the garment 10 should be able to keep the wearer dry and warm. Additionally, such activities can result in additional wear and tear on some portions of the garment 10 compared to other portions of the garment 10. In some embodiments, the garment 10 can be a pair of rain pants or the like. The garment 10 as pants is an example. Additional embodiments can include a jacket or the like.

In some embodiments, the garment 10 includes legs 12 and a waist 14. In some embodiments, the waist 14 can have an opening for the wearer of the garment 10. In the illustrated embodiment, the waist 14 includes belt loops 16. It is to be appreciated that the belt loops 16 can be optional. In some embodiments, the waist 14 can include one or more additional features such as elastic for conforming to wearers of different sizes, a belt or other features for the wearer to tighten the garment 10, a zipper 18, buttons, or the like.

The legs 12 can be mirror images of each other. Each of the legs 12 can have the same features located in different areas. For simplicity of this Specification, unless expressly referenced otherwise, the legs 12 will be collectively described in additional detail. It is to be appreciated that one of the legs 12 can be different than the other of the legs 12. The legs 12 include a pocket 20 near the waist 14. It is to be appreciated that the legs 12 can include one or more additional pockets.

The legs 12 can be divided into several portions including a first garment portion 22, a second garment portion 24, and a third garment portion 26. The first garment portion 22 can be generally referred to as a pants leg. The second garment portion 24 can be generally referred to as a pants cuff. The third garment portion 26 can be generally referred to as a gaiter. The relative sizing of the portions can vary. For example, in some embodiments, the first garment portion 22 can extend from the waist 14 to a knee of the legs 12, the second garment portion 24 from the knee to the ankle, and the third garment portion 26 from the first garment portion 22 to the ankle. In the illustrated embodiment, the first garment portion 22 can extend to a shin of the legs 12, the second garment portion 24 from the shin to the ankle, and the third garment portion 26 from the first garment portion 22 to the ankle.

The second garment portion 24 can terminate at an open end of the legs 12. The third garment portion 26 can include elastic at an open end 28. As a result, the third garment portion 26 can be configured to fit into, for example, a boot or shoe of the wearer and the second garment portion 24 can be configured to fit over the boot or shoe of the wearer. In some embodiments, the legs 12 can include a zipper. The zipper (not shown) can be used to expand a size of the second garment portion 24 so that, for example, the second garment portion 24 fits over the boot or shoe of the wearer.

In some embodiments, the first garment portion 22 and the second garment portion 24 are separable to replace the second garment portion 24. For example, in some instances, the second garment portion 24 may wear out before the first garment portion 22 and be replaced to renew the garment 10 for additional use.

In some embodiments, the first garment portion 22 and the third garment portion 26 are separable to replace the third garment portion 26. For example, in some instances, the third garment portion 26 may wear out before the first garment portion 22 and be replaced to renew the garment 10 for additional use.

In some embodiments, the second garment portion 24 or the third garment portion 26 can be replaced independently from the other. In some embodiments, the second garment portion 24 and the third garment portion 26 can be replaced at the same time. That is, the connection (e.g., a first connection) between the first garment portion 22 and the second garment portion 24 are separate and independent of the connection (e.g., a second connection) between the first garment portion 22 and the third garment portion 26. This unique configuration can enable the targeted replacement of the second garment portion 24 and the third garment portion 26, as needed, which may be carried out at different times based on the wear of the respective portion(s).

In some embodiments, the second garment portion 24 can include a guard portion 30 that can include a different material than the remainder of the garment 10. The guard portion 30 may be an abrasion resistant material, a cut-resistant material, or some combination thereof, that may be selected to increase a lifetime of the second garment portion 24 even when subject to repeated use. In some embodiments, the guard portion 30 may not be included, and the second garment portion 24 can include a same material as the first garment portion 22.

Figure 3:
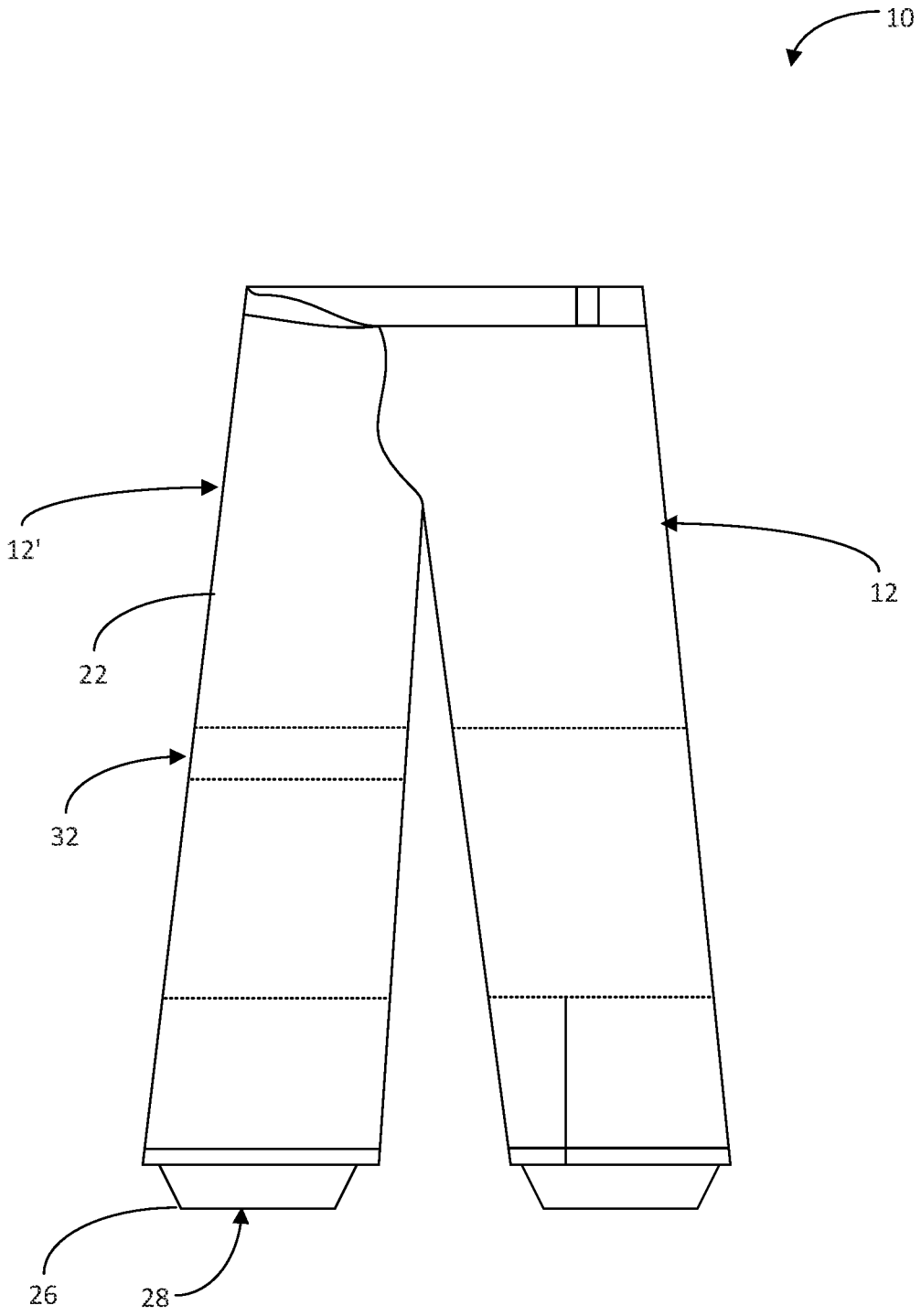
FIG. 3 shows the garment of FIG. 1 with a portion of the garment inside out, according to some embodiments.
Figure 4:
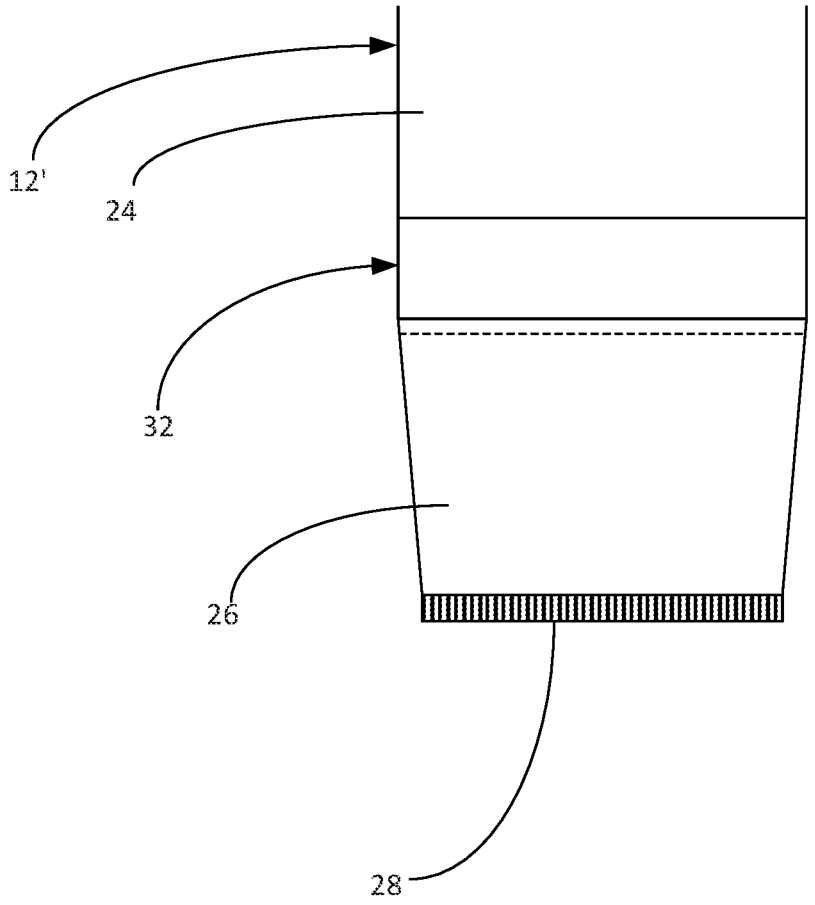
FIG. 4 shows a partial view of the garment of FIG. 1 with a portion of the garment inside out, according to some embodiments.

FIG. 3 shows the garment 10 with a portion of the garment 10 inverted, or turned "inside out," according to some embodiments. FIG. 4 shows a partial view of the garment 10 with the second portion 24 of the garment 10 inverted, or turned "inside out," according to some embodiments. In FIG. 3, one of the legs 12' is inside out while the other of the legs 12 is not (i.e., leg 12 is "right side out"). Unless specific reference is made otherwise, for simplicity of this Specification, FIGS. 3-4 will be addressed collectively.

In the illustrated embodiment, the second connection between the first garment portion 22 and the third garment portion 26 is not visible (when viewed on the leg 12 that is right side out). In contrast, the second connection is visible between the first garment portion and the third garment portion, when the leg 12' is turned inside out in FIG. 3. As is also illustrated in FIG. 3, the first garment portion 22 includes a connecting portion 32 to which the third garment portion 26 is secured. For purposes of the embodiment, it should be understood that the connecting portion 32 is a part of the first garment portion 22. When replacing the third garment portion 26, the connecting portion 32 is not replaced. The connecting portion 32 enables the first garment portion 22 and the third garment portion 26 to be joined together in a manner that the second garment portion 24 (not visible in FIG. 3 on the leg 12' that is turned inside out) is not disturbed or impacted when replacing the third garment portion 26. That is, the connecting portion 32 can enable the third garment portion 26 to be replaced in the garment 10 without replacing the second garment portion 24.

Figure 5:
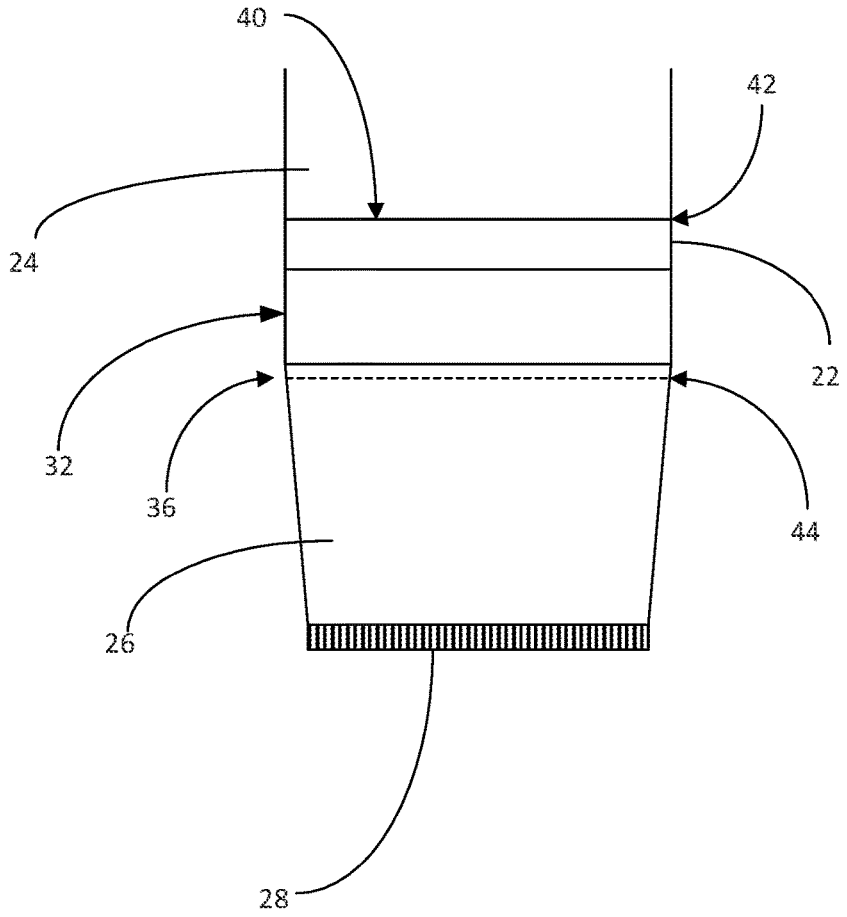
FIG. 5 shows a partial view of the garment of FIG. 1 with a second garment portion inside out, according to some embodiments.
Figure 6:
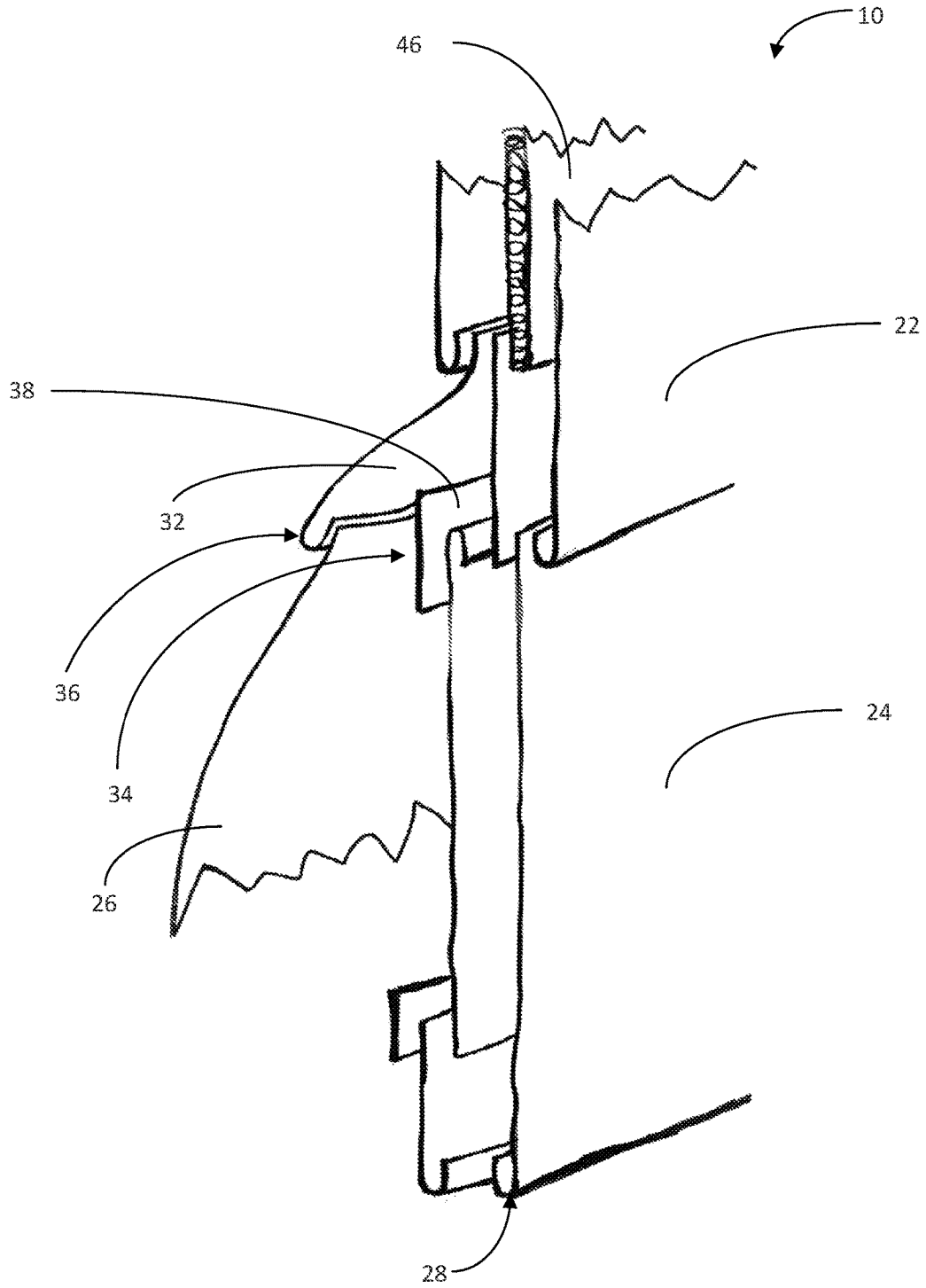
FIG. 6 shows a partial exploded view of the garment of FIG. 1, according to some embodiments.
Figure 7:
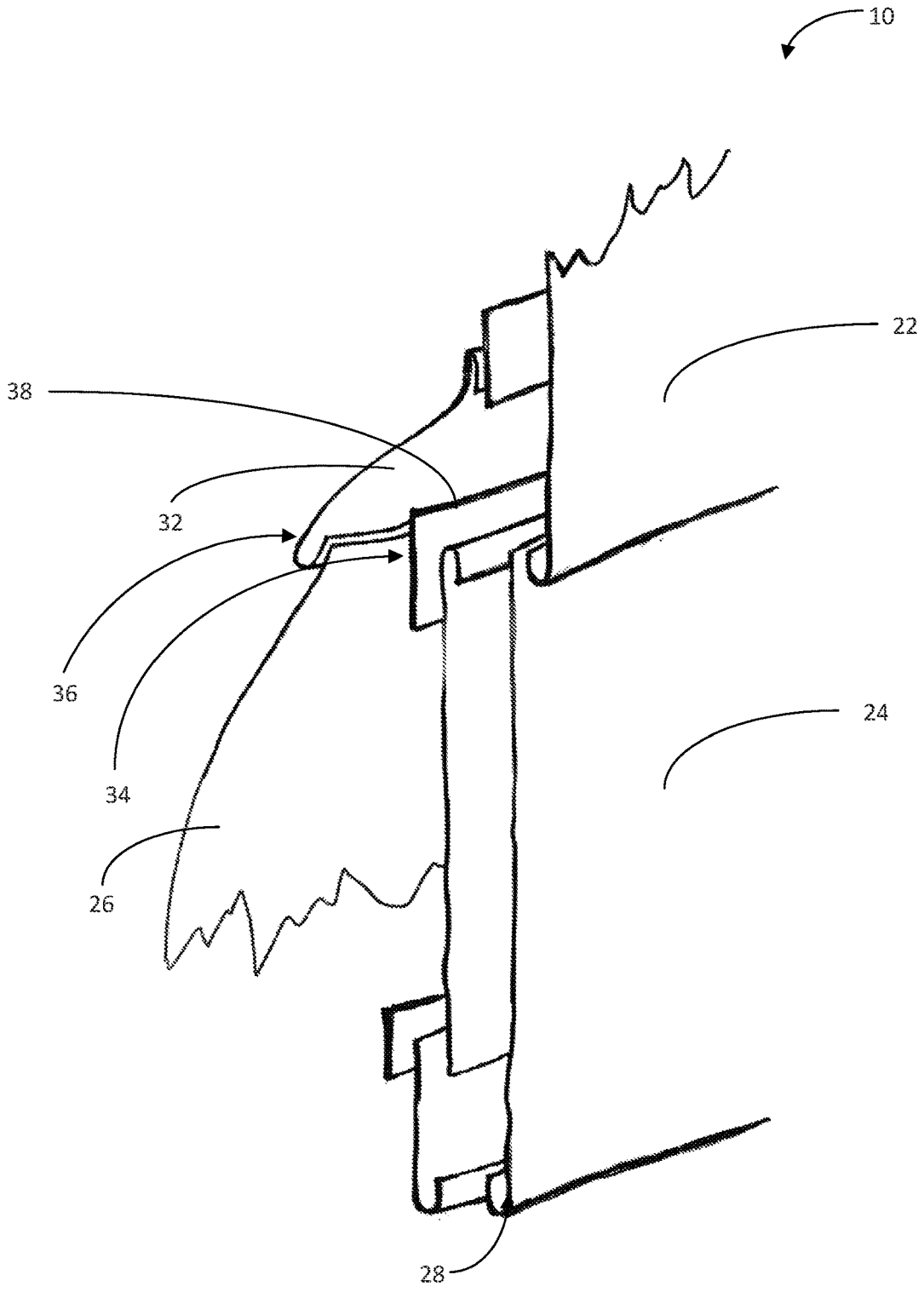
FIG. 7 shows a partial exploded view of the garment of FIG. 1, according to some embodiments.

FIG. 5 shows a partial view of one leg of the garment 10 with the second garment portion 24 rolled up out of the way so that the connecting portion 32 of the third garment portion 26 is visible, according to some embodiments. In the illustrated embodiment, the second connection 44 between the third garment portion 26 and the connecting portion 32 of the first garment portion 22 is visible. Also, a portion of the first connection 40 between the first garment portion 22 and the second garment portion 24 is visible. FIG. 6 shows a partial exploded view of one leg of the garment 10, according to some embodiments. FIG. 7 shows a partial exploded view of one leg of the garment 10, according to some embodiments. Unless expressly noted otherwise, reference will be made collectively to FIGS. 5-7.

In some embodiments, the garment 10 includes a waterproof fastener system 34 and a non-waterproof fastener system 36.

In some alternative embodiments, the waterproof fastener system 34 includes a seam tape 38 that is arranged over a top of the first connection 40 (FIG. 5) that joins the first garment portion 22 and the second garment portion 24. In some embodiments, the first connection 40 (FIG. 5) includes a stitched connection, a glued connection, a welded connection, or a combination thereof. In other embodiments, the first connection 40 consists of a stitched connection, a glued connection, a welded connection, or a combination thereof. In some alternative embodiments, the first connection 40 (FIG. 5) consists essentially of a stitched connection, a glued connection, a welded connection, or a combination thereof. In some embodiments, the waterproof fastener system 34 is configured to prevent water entry through the first connection 40 (FIG. 5).

In some embodiments, when the second garment portion 24 is to be replaced, the garment 10 can be cut (e.g., with scissors or the like) at the waterproof fastener system 34 at a location that is on a side of the first garment portion 22 from the first connection 40 (FIG. 5). That is, in some embodiments, a portion of the first garment portion 22 can be cut. In some embodiments, when the second garment portion 24 is to be replaced, the garment 10 can be cut (e.g., with scissors or the like) at the waterproof fastener system 34 at a location that is on a side of the second garment portion 24 from the first connection 40 (FIG. 5). That is, in some embodiments, a portion of the second garment portion 24 can be cut. Once removed, a fourth garment portion (i.e., to replace the second garment portion 24) can be connected to the first garment portion 22. It is to be appreciated that the fourth garment portion is not a patch, but is similar to the second garment portion 24 except for variances in, for example, length, taper, color, etc. In some embodiments, the fourth garment portion can be a different material than the second garment portion 24.

In some embodiments, the manner of connecting the fourth garment portion to the first garment portion 22 can be any suitable manner of connecting two garment portions such as, but not limited to, stitching, welding, adhering with an adhesive, any combination thereof, or the like. Once the first garment portion 22 and the fourth garment portion are connected, a replacement seam tape may be applied over the first connection, as appropriate, to complete the waterproof fastener system 34. Because a portion 42 (FIG. 5) of the first garment portion 22 may be cut in certain embodiments in order to replace the second garment portion 24, the fourth garment portion that is replacing the second garment portion 24 can have a length that is different than the length of the second garment portion 24 being removed.

The non-waterproof fastener system 36 includes a second connection 44 (FIG. 5). In some embodiments, the second connection 44 (FIG. 5) can be a stitch, a weld, an adhesive joint, any combination thereof, or the like. In some embodiments, the second connection 44 is visibly different than other connections in the garment 10. As a result, a person replacing the third garment portion 26 can more easily identify the appropriate connection to remove in order to replace the third garment portion 26. In some embodiments, the second connection 44 is a stitch. In some embodiments, the stitch is visibly different than other stitches in the garment 10. For example, in some embodiments the stitch is a different color, a different stitch pattern, a different stitch length, any combination thereof, or the like. In some embodiments, to replace the third garment portion 26, the second connection 44 (FIG. 5) can be undone (e.g., by cutting or otherwise removing the second connection 44 (FIG. 5)). It is to be appreciated that when installing a replacement for the third garment portion 26, the second connection 44 (FIG. 5) may or may not be visibly different than other connections of the garment 10. That is, the person replacing does not need to use a particular connection type to replace the third garment portion 26.

In some embodiments, the garment 10 can include an insulation layer 46 (FIG. 6). In some embodiments, the garment 10 may not include an insulation layer (FIG. 7).

Figure 8:
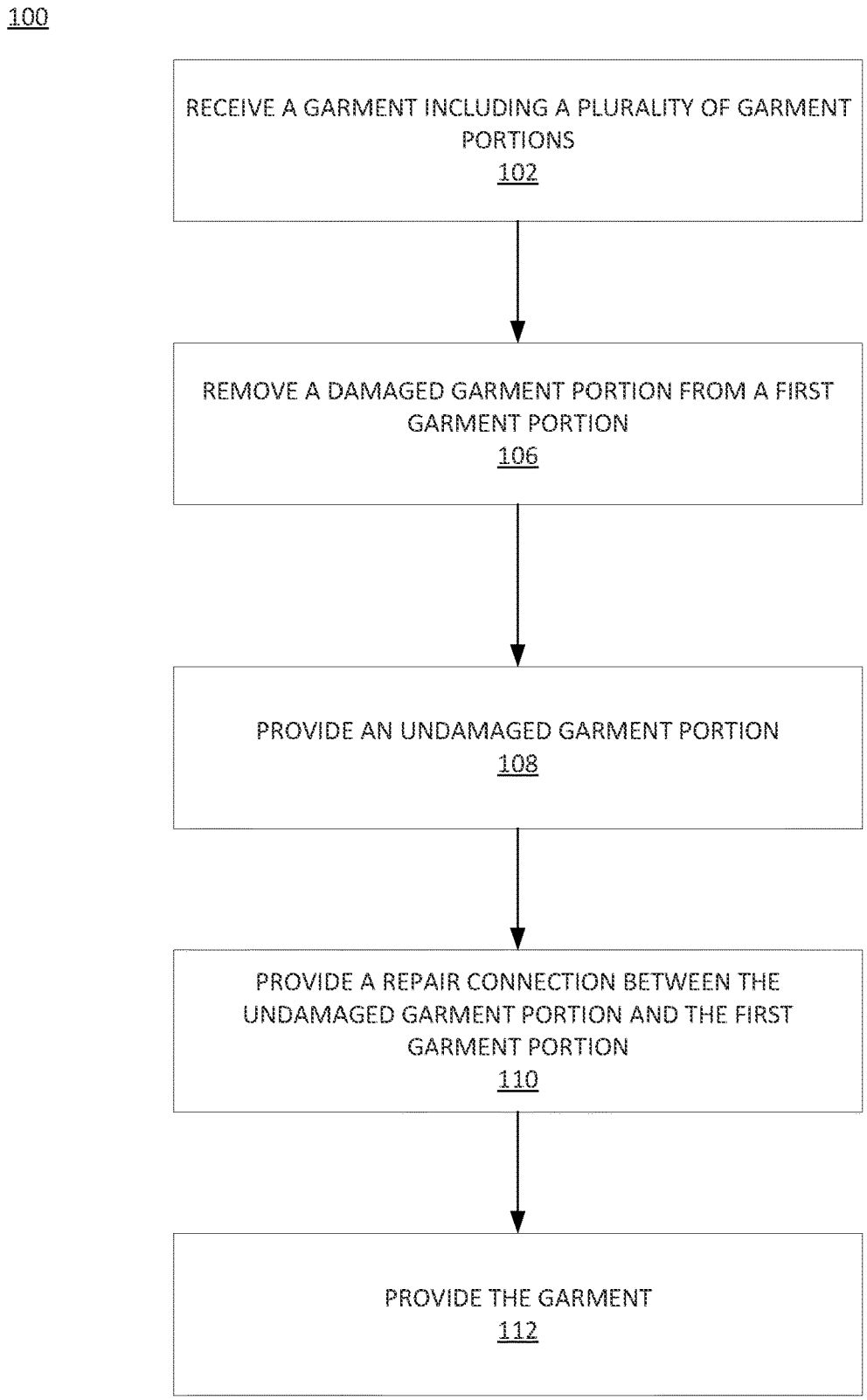
FIG. 8 shows a flowchart of a method, according to some embodiments.

FIG. 8 shows a flowchart of a method 100 for repairing a garment with one or more replaceable portions which are subject to greater wear and tear, and thus damage, than other portions of the garment, according to some embodiments. The method 100 can generally be performed by obtaining, receiving, or otherwise procuring, a garment having replaceable portions (e.g., the garment 10 of FIGS. 1-7), one or more of which may require replacement and to replace the one or more damaged garment portions (e.g., the second garment portion 24 or the third garment portion 26 of FIGS. 1-7) of the garment.

At block 102, the method 100 includes obtaining, receiving, or otherwise procuring a garment that includes a plurality of garment portions (e.g., first garment portion 22, second garment portion 24, third garment portion 26, etc.). In some embodiments, the plurality of garment portions include a first garment portion, a second garment portion, and a third garment portion. In some embodiments, the first garment portion and the second garment portion are joined by a waterproof fastener system (e.g., second garment portion waterproof fastener system 34 in FIGS. 5-7). In some embodiments, the waterproof fastener system includes a first stitched connection and a sealed seam. In some embodiments, the first garment portion and the third garment portion are joined by a second connection that is configured to withstand repeated repair and be disconnected or rejoined. In some embodiments, the first garment portion and the third garment portion are joined by a second connection that is configured to withstand repeated repair and be easily disconnected or rejoined.

At block 102, in some embodiments, the second garment portion, the third garment portion, or both the second garment portion and the third garment portion are in a damaged condition.

At block 106, the method 100 includes removing the damaged second garment portion from the first garment portion at a region proximate to the waterproof fastener system and/or removing the damaged third garment portion from the first garment portion at the second connection.

At block 108, the method 100 includes providing a fourth garment portion corresponding to an undamaged replacement portion for the second garment portion or the third garment portion.

At block 110, the method includes providing a repair connection between the fourth garment portion and the first garment portion. In some embodiments, the fourth garment portion is joined, and seam sealed to provide a waterproof repair fastener system wherein the fourth garment portion is a new or replacement (e.g., undamaged or limited damage) portion for the second garment portion. In some embodiments, the fourth garment portion is joined to provide a repair connection wherein the fourth garment portion is a new or replacement (e.g., undamaged or limited damage) portion for the third garment portion. In some embodiments, the repair connection is configured to withstand repeated repair and be easily disconnected and rejoined.

At block 112, the method 100 includes providing the garment in a repaired state.

In some embodiments, the method 100 includes repeating blocks 102-112 at least two times and providing a fifth, sixth or subsequent garment portion that comprises a new or replacement (e.g., undamaged or limited damage) portions in order to complete each additional repair.

In some embodiments, the garment and method described herein can provide a repairable garment in which multiple portions of the garment may be replaced to target a specific portion of the garment instead of rendering the entire garment obsolete. In some embodiments, the garment and method described herein can provide an easily repairable garment in which multiple portions of the garment may be replaced to target a specific portion of the garment instead of rendering the entire garment obsolete. In some embodiments, the repaired garment looks the same as the original garment, as the replacement is carried out without the use of patches that might otherwise highlight that a garment is repaired. In further embodiments within the scope of the present invention, the garment can be a jacket and the replaceable portions can be a sleeve cuff, a sleeve gaiter, a jacket collar, a jacket gaiter (e.g., a snow gaiter or skirt), a draw cord and in some embodiments a draw cord tunnel, a zipper at any location on the jacket or a combination thereof. In these further exemplary embodiments, a sleeve and a sleeve cuff may correspond to the first and second garment portions attached by a waterproof fastener system, while a sleeve gaiter or jacket gaiter may correspond to the third garment portion attached by a non-waterproof fastener system. A jacket collar and a zipper may typically use a waterproof fastener system, while a draw cord may include a replaceable cord tunnel and a waterproof or a non-waterproof fastener system. While the garment was described in terms of a pair of pants with first, second, third and fourth garment portions, any of the above listed replaceable portions may be included as a fifth, sixth or subsequent garment portions.

The terminology used herein is intended to describe embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

It is to be understood that changes may be made in detail, especially in matters of the construction materials employed and the shape, size, and arrangement of parts without departing from the scope of the present disclosure. This Specification and the embodiments described are examples, with the true scope and spirit of the disclosure being indicated by the claims that follow.

What is claimed is:

1. A garment, comprising: a first garment portion; a second garment portion; a third garment portion; a waterproof fastener system configured to join the first garment portion and the second garment portion; wherein the waterproof fastener system is disconnected and rejoined without removing the third garment portion; wherein the waterproof fastener system includes a first connection joining the first garment portion to the second garment portion; wherein the waterproof fastener system is configured to prevent water entry through first connection; and a non- waterproof fastener system configured to join the first garment portion and the third garment portion; wherein the non-waterproof fastener system includes a second connection joining the first garment portion to the third garment portion; wherein the second connection is configured to: withstand repeated repair; and be disconnected and rejoined, wherein (1) the first garment portion is a pants leg, the second garment portion is a pants cuff, and the third garment portion is a gaiter, or (2) the first garment portion is a sleeve, the second garment is a sleeve cuff, and the third garment portion is a sleeve gaiter.

2. The garment of claim 1, wherein the second connection is visibly different from other connections of the garment.

3. The garment of claim 2, wherein the second connection is a different color from other connections of the garment.

4. The garment of claim 2, wherein the second connection is a stitched connection, and the stitched connection is a different stitch pattern from other stitches of the garment.

5. The garment of claim 1, wherein the second garment portion and the third garment portion is not a patch.

6. The garment of claim 1, wherein the waterproof fastener system comprises a first stitched connection and a sealed seam.

7. The garment of claim 1, wherein the waterproof fastener system consists essentially of a first stitched connection and a sealed seam.

8. The garment of claim 1, wherein the waterproof fastener system consists of a first stitched connection and a sealed seam.

9. A method comprising:

(a) receiving a garment having a plurality of garment portions;

wherein the plurality of garment portions comprises a first garment portion, a second garment portion, and a third garment portion;

the first garment portion and the second garment portion are joined by a waterproof fastener system, the waterproof fastener system comprising a first stitched connection and a sealed seam;

wherein the first garment portion and the third garment portion are joined by a second connection that is configured to withstand repeated repair and be disconnected and rejoined;

wherein the second garment portion, the third garment portion, or both the second garment portion and the third garment portion are damaged; and wherein (1) the first garment portion is a pants leg, the second garment portion is a pants cuff, and the third garment portion is a gaiter, or (2) the first garment portion is a sleeve, the second garment is a sleeve cuff, and the third garment portion is a sleeve gaiter;

(b) removing the damaged second garment portion from the first garment portion;

(c) providing a fourth garment portion corresponding to an undamaged replacement portion for the second garment portion or the third garment portion;

(d) providing a repair connection between the fourth garment portion and the first garment portion;

wherein the stitched repair connection is configured to withstand repeated repair and be disconnected and rejoined; and (e) providing the repaired garment;

wherein steps (a)-(e) are repeated at least two times.

10. The method of claim 9, wherein the repair connection is visibly different from other connections of the garment.

11. The method of claim 9, wherein the repair connection is a stitched connection.

12. The method of claim 11, wherein the repair connection is visibly different from other connections of the garment.

13. The method of claim 9, wherein removing the damaged second garment portion from the first garment portion comprises:

cutting the first garment portion at a location proximate to the waterproof fastener system.

14. The method of claim 9, wherein removing the damaged second garment portion from the first garment portion comprises:

removing a stitch forming the second connection.

15. The method of claim 9, wherein the fourth garment portion corresponds to the undamaged third garment portion, and further comprising:

(f) providing a fifth garment portion comprising an undamaged replacement portion for the third garment portion.

16. The method of claim 15, further comprising:

(g) providing a repair connection between the fifth garment portion and the first garment portion; and wherein the fifth garment portion is joined to provide a repair connection;

wherein the repair connection is configured to withstand repeated repair and be disconnected and rejoined.

17. The method of claim 16, wherein the repair connection is a stitched connection.

18. The method of claim 17, wherein the repair connection is visibly different from other connections of the garment.

19. The method of claim 9, wherein the fourth garment portion is joined and seam sealed to provide a waterproof repair fastener system when the fourth garment portion corresponds to the undamaged second garment portion.

20. The method of claim 9, wherein the fourth garment portion is joined to provide a repair connection when the fourth garment portion corresponds to the undamaged third garment portion.

* * * * *